US007093604B2

(12) United States Patent
Jung et al.

(10) Patent No.: US 7,093,604 B2
(45) Date of Patent: Aug. 22, 2006

(54) DISHWASHER WITH HEATER AND METHOD OF CONTROLLING THE SAME

(75) Inventors: Tae-Young Jung, Hwasung (KR); Woon-Gu Hur, Suwon (KR); Sam-Young Jang, Yongin (KR); Je-Hak Woo, Suwon (KR); Wang-Seok Son, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 251 days.

(21) Appl. No.: 10/689,518

(22) Filed: Oct. 21, 2003

(65) Prior Publication Data

US 2004/0134519 A1 Jul. 15, 2004

(30) Foreign Application Priority Data

Nov. 1, 2002 (KR) ..... 10-2002-0067443
Mar. 28, 2003 (KR) ..... 10-2003-0019728

(51) Int. Cl.
*B08B 3/00* (2006.01)

(52) U.S. Cl. ..... 134/25.2; 134/56 D

(58) Field of Classification Search ..... 134/25.2, 134/25.3, 56 D, 57 D, 58 D
See application file for complete search history.

(56) References Cited

U.S. PATENT DOCUMENTS 4,247,158 A * 1/1981 Quayle ..... 312/213
4,326,552 A * 4/1982 Bleckmann ..... 134/99.1
5,277,210 A * 1/1994 Kim ..... 134/95.2
5,355,900 A * 10/1994 Sakata ..... 134/95.2
5,947,135 A * 9/1999 Sumida et al. ..... 134/95.3

OTHER PUBLICATIONS

U.S. Appl. No. 10/689,507, filed Oct. 9, 2003, Tae-Young Jung, et al.

* cited by examiner

*Primary Examiner*—Michael Barr
*Assistant Examiner*—Saeed Chaudhry
(74) *Attorney, Agent, or Firm*—Staas & Halsey LLP

(57) ABSTRACT

A method of controlling a dishwasher, which heats air in a washing chamber while supplying water into the washing chamber to generate hot water through a heat exchange between the heated air and the supplied water. Further, a second method of controlling a dishwasher operates an air generator while starting of the supplying of water into a washing chamber to heat the supplied water and air in the washing chamber. If a temperature of the water in the washing chamber exceeds a first reference value, the supplying of water is stopped and the air generator is operated. If a temperature of the air in the washing chamber exceeds a second reference value, the supplying of water is started.

27 Claims, 9 Drawing Sheets

DISHWASHER WITH HEATER AND METHOD OF CONTROLLING THE SAME

CROSS-REFERENCE TO RELATED APPLICATIONS

This application claims the benefit of Korean Application No. 2002-67443, filed on Nov. 1, 2002 and Korean Application No. 2003-19728, filed on Mar. 28, 2003, in the Korean Intellectual Property Office, the disclosure of which is incorporated herein by reference.

BACKGROUND OF THE INVENTION

1. Field of the Invention

The present invention relates, in general, to a dishwasher and method of controlling the same and, more particularly, to a dishwasher and method of controlling the same, which is provided with a heater to heat washing and rinsing water, and which performs washing, rinsing and drying processes while using the heater.

2. Description of the Related Art

A dishwasher is an apparatus that removes contaminants from dishes by spraying a cool water or a hot water on the dishes disposed on racks in a washing chamber. To remove contaminants, pumps and nozzles are basically required to spray a washing water and a rinsing water, and a heater is required to generate the hot water. Herein is described a conventional dishwasher with reference to FIG. 1.

FIG. 1 is a vertical sectional view of a conventional dishwasher 100. As shown in FIG. 1, a washing chamber 104 having an opening in a front thereof is provided in a body 102 of the conventional dishwasher 100, and a door 106 that is selectively opened or closed is connected to the front of the body 102 with hinges. Dish racks 104*a*, provided to hold dishes, are disposed in upper and lower portions of the washing chamber 104 to slide in both forward and backward directions. Upper and lower spray nozzles 104*c* that spray the washing water on the dishes are disposed under the dish racks 104*a*, respectively.

A heater 150 that heats the washing and rinsing water and therefore generates the hot water is disposed under the dish rack 104*a* seated in the lower portion of the washing chamber 104. If the washing or rinsing water is supplied into the washing chamber 104 and the heater 150 is submerged under the water, the hot water is generated by a heat exchange between the supplied water and the heater 150. The hot water is used to remove food dregs on the dishes, or to soak dried food dregs in the water and remove the dried food dregs in a washing process. The hot water is used to heat the dishes for a rinsing process. If the dishes are heated using the hot water for a last operation of the rinsing process, water is rapidly vaporized by a latent heat of the dishes in a drying process to be later performed.

A water tank 108 is disposed in a separate space under the dish rack 104*a* seated in the lower portion of the washing chamber 104 to contain washing or rinsing water. The water tank 108 is connected to a discharge pump 110 and a water supply pump 112 through a discharge pipe 110*a* and a circulation pipe 112*a*, respectively. The circulation pipe 112*a* is connected to water supply pipes 104*b* connected to upper and lower spray nozzles 104*c*, respectively.

With this construction, the washing or rinsing water sprayed from the upper and lower spray nozzles 104*c*, which is circulated inside the washing chamber 104, passes through the water tank 108 and the circulation pipe 112*a*, is supplied to the water supply pipes 104*b*, and then is resprayed by the upper and lower spray nozzles 104*c*, and is recirculated inside of the washing chamber 104 by an action of the water supply pump 112. When a washing time elapses or a rinsing time elapses, the washing or rinsing water discharges outside the body 102 of the conventional dishwasher 100 by an action of the discharge pump 110.

In the conventional dishwasher 100 having the heater 150 therein, since the heater 150 is submerged under the water to generate the hot water, compounds of calcium (e.g., calcites) form on a surface of the heater 150, so that a lifetime of the heater 150 is shortened. Further, since the water is directly heated, relatively large periods of time are required to generate the hot water. Further, in a case where air in the washing chamber 104 is heated to perform a drying process using the heater 150, dishes are excessively heated, so that removing the dishes immediately after the drying process is complete is inconvenient for a user.

A model of a convention dishwasher exists in which an exterior heater is installed in a separate space outside the washing chamber and is constructed to supply water heated by the heater to the washing chamber. In this case, since the heater is submerged under the water to generate the hot water, there remains the problems that the lifetime of the heater is shortened by the heater being covered with the calcium compounds, a washing time is increased by a direct heating of the water, and considerable energy is consumed. Further, the conventional dishwasher having the exterior heater rinses dishes using the hot water for the last operation of the rinsing process instead of heating air in the washing chamber to prevent the dishes from being excessively heated for the drying process, so that the dishes are properly heated and will be rapidly dried by the latent heat of the dishes in the drying process to be later performed. As described above, since the conventional dishwasher having the exterior heater dries the dishes using the latent heat, rinsing using the hot water should be performed at the last operation of the rinsing process just prior to the drying process. Accordingly, an independent drying process in which the water is not required cannot be performed. Further, since the rinsing of the dishes using the hot water is performed at the last operation of the rinsing process just prior to the drying process, unnecessary power results, so that an energy consumption efficiency of the conventional dishwasher is decreased.

SUMMARY OF THE INVENTION

Accordingly, it is an aspect of the present invention to provide a dishwasher, in which air with a low specific heat in the dishwasher is heated and then hot water is generated using the heated air, thereby decreasing a washing period, increasing an energy consumption efficiency and extending a lifetime of a heater.

Another aspect is to provide a method of controlling a dishwasher, which heats air in a washing chamber and simultaneously supplies water into the washing chamber, thereby generating hot water through a heat exchange between the heated air and the supplied air.

Additional aspects and/or advantages of the invention will be set forth in part in the description which follows and, in part, will be obvious from the description, or may be learned by practice of the invention.

The above and/or other aspects are achieved by providing a method of controlling a dishwasher, which heats air in a washing chamber while supplying water into the washing chamber, thereby generating hot water through a heat exchange between the heated air and the supplied water.

The above and/or other aspects are achieved by providing a method of controlling a dishwasher, which operates an air generator while starting a supply of water into a washing chamber, thereby heating the supplied water and air in the washing chamber. If a temperature of the supplied water in the washing chamber exceeds a first reference value, the supplying of water is stopped and the air generator is operated. If a temperature of the air in the washing chamber exceeds a second reference value, the supplying of water is started.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
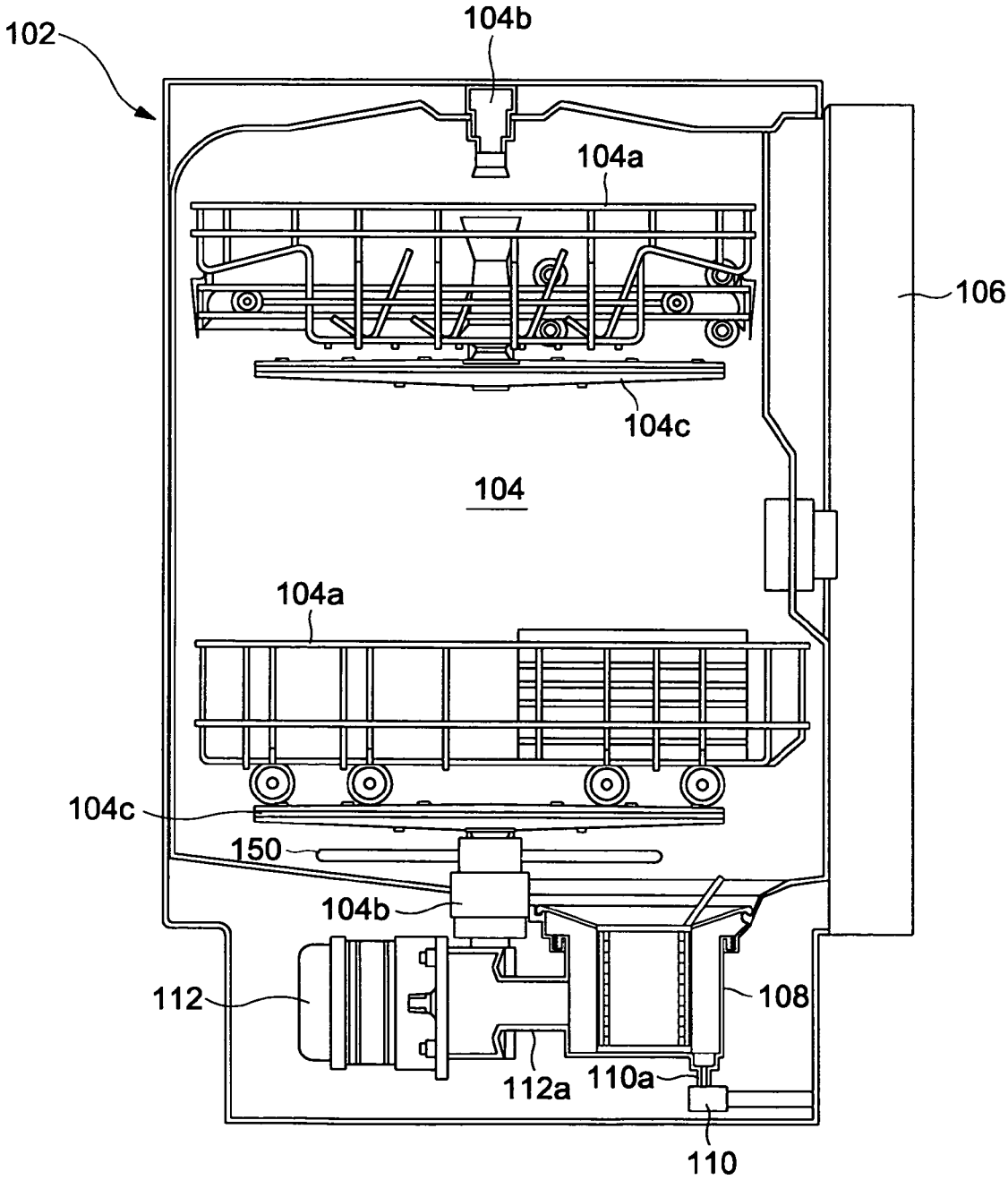
FIG. 1 (PRIOR ART)
FIG. 1 is a vertical sectional view of a conventional dishwasher.

Reference will now be made in detail to the present preferred embodiments of the present invention, examples of which are illustrated in the accompanying drawings, wherein like reference numerals refer to like elements throughout. The embodiments are described below in order to explain the present invention by referring to the figures.

Figure 2A:
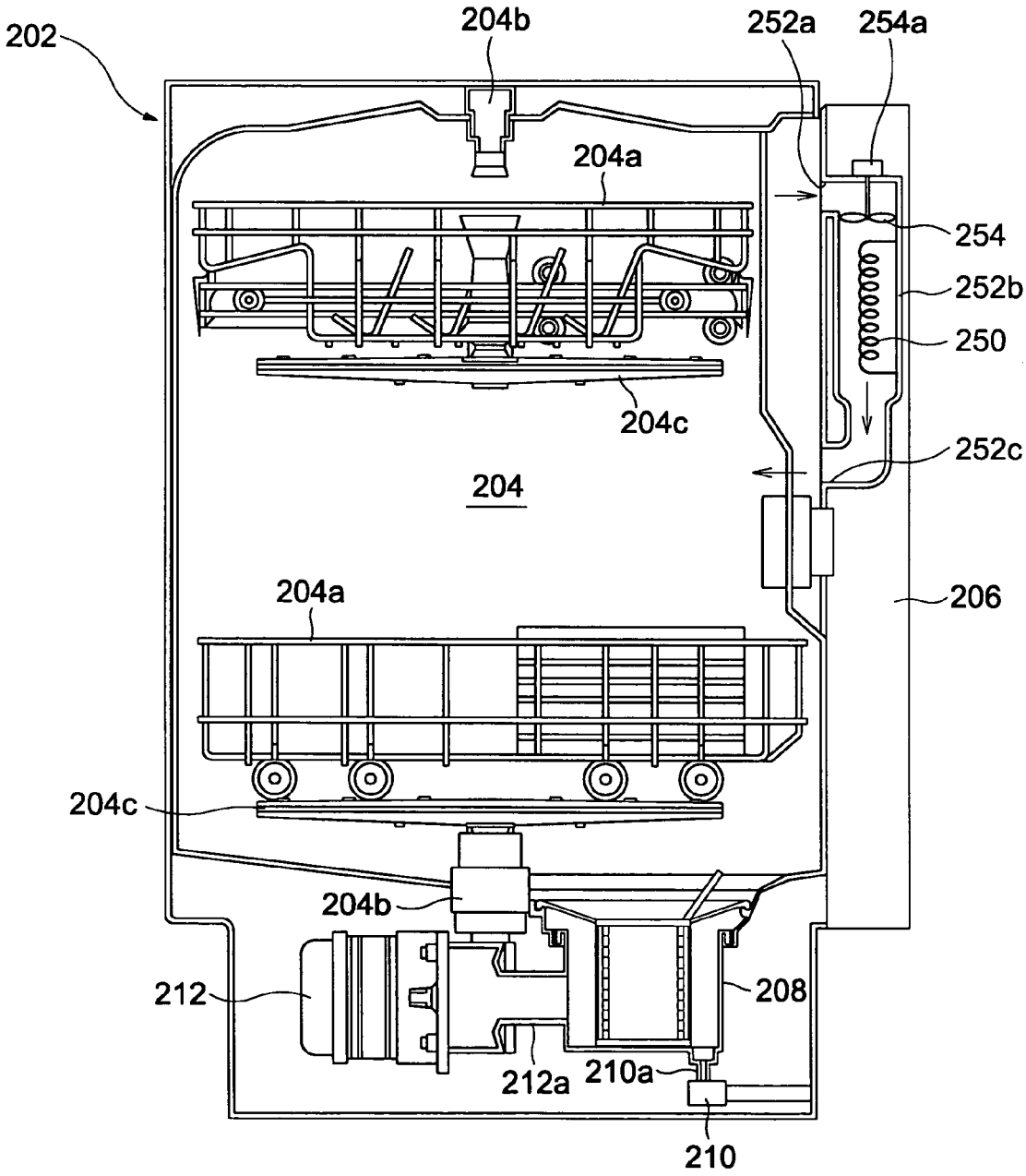
FIG. 2A is a vertical sectional view of a dishwasher, according to a first embodiment of the present invention.

There are described embodiments of a dishwasher and a method of controlling the same in accordance with the present invention with reference to FIG. 2A to FIG. 8. FIG. 2A is a vertical sectional view of a dishwasher 200, according to a first embodiment of the present invention. As shown in FIG. 2A, a washing chamber 204 having an opening in a front thereof is provided in a body 202 of the dishwasher 200, and a door 206 that is selectively opened or closed is connected to the front of the body 202 with hinges. Upper and lower dish racks 204*a*, provided to hold dishes, are disposed in upper and lower portions of the washing chamber 204 to slide in both forward and backward directions. Upper and lower spray nozzles 204*c* that spray washing water on the dishes are disposed under the upper and lower dish racks 204*a*, respectively. A water tank 208 is disposed under the washing chamber 204 to contain the washing water or rinsing water. The water tank 208 is connected to a discharge pump 210 and a water supply pump 212 through a discharge pipe 210*a* and a circulation pipe 212*a*, respectively. The circulation pipe 212*a* is connected to water supply pipes 204*b*, which is connected to the upper and lower spray nozzles 204*c*.

With this construction, the washing or rinsing water sprayed from the spray nozzles 204*c*, which is circulated inside the washing chamber 204, passes through the water tank 208 and the circulation pipe 212*a*, is supplied to the water supply pipes 204*b*, and then is resprayed by the upper and lower spray nozzles 204*c*, and is recirculated inside of the washing chamber 204 by an action of the water supply pump 212. When a washing time elapses or a rinsing time elapses, the washing or rinsing water discharges to outside the body 202 of the dishwasher 200 by an action of the discharge pump 210.

A heater 250 and a blowing fan 254 are disposed in the door 206 to heat and circulate air in the washing chamber 204, respectively. An air inlet 252*a* and a blowing outlet 252*c* are disposed in a surface of the door 206 facing the washing chamber 204, and communicate with each other through a blowing pipe 252*b*. The blowing fan 254, rotated by a fan motor 254*a*, is disposed beside the air inlet 252*a* in the blowing pipe 252*b*. The heater 250 that heats the air is disposed in a middle of the blowing pipe 252*b*. When the blowing fan 254 is rotated, the air in the washing chamber 204 is drawn into the blowing pipe 252*b*. The drawn air is heated by the heater 250, supplied into the washing chamber 204 through the blowing outlet 252*c*, and then circulated in the washing chamber 204.

In the dishwasher 200, positions of the heater 250 to heat the air in the washing chamber 204 and the blowing fan 254 are not limited to an inside of the door 206 but may be disposed in other positions of the body 202 of the dishwasher 200. Further, the dishwasher 200 may be provided with an independent casing outside of the body 202, so that the heater 250 and the blowing fan 254 may be disposed in the casing.

Further, the air inlet may be disposed in one of an inside of the washing chamber 204 or the outside of the body 202 of the dishwasher 200, so that the air, which is both inside of the washing chamber 204 and outside of the dishwasher 200, is sucked and heated, and the heated air is supplied into the washing chamber 204. Further, the air inlet may be only disposed outside of the dishwasher 200, so that the air outside of the dishwasher 200 is sucked and heated, and the heated air is supplied into the washing chamber 204.

Figure 2B:
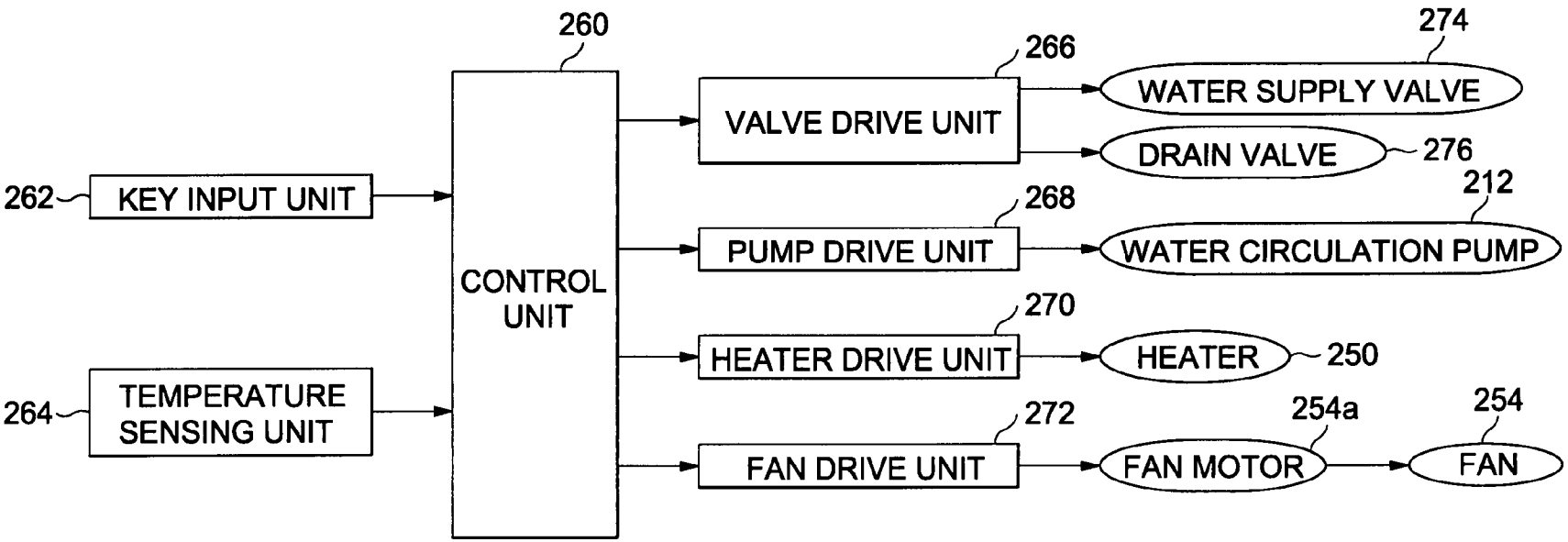
FIG. 2B is a block diagram of a construction of the dishwasher, according to the first embodiment of the present invention.

FIG. 2B is a block diagram of a construction of the dishwasher 200, according the first embodiment of to the present invention. As shown in FIG. 2B, a control unit 260, which controls an overall operation of the dishwasher 200, is connected at input terminals thereof to a key input unit 262 and a temperature sense unit 264. The key input unit 262 is used to receive operating conditions of the dishwasher 200 from a user and set the operating conditions. The temperature sense unit 264 is used to measure a temperature of the air in the washing chamber 204.

The control unit 260 is connected at output terminals thereof to a water supply/discharge valve drive unit 266, a water supply pump drive unit 268, a heater drive unit 270 and a fan drive unit 272. The water supply/discharge valve drive unit 266 is used to drive a water supply valve 274 and a water discharge valve 276. The water supply pump drive unit 268 and the heater drive unit 270 are used to drive the water supply pump 212 and the heater 250, respectively. The fan drive unit 272 drives the fan motor 254*a* to operate the blowing fan 254.

The combined operations of the dishwasher 200 are shown in the following Table 1.

TABLE 1

| Classification | Case 1 | Case 2 | Case 3 | Case 4 | Case 5 |
|---|---|---|---|---|---|
| Blowing fan | ON | ON | ON | OFF | OFF |
| Heater | ON | ON | OFF | ON | OFF |
| Water supply pump | ON | OFF | OFF | ON | ON |

As shown in Table 1, the dishwasher 200 is provided with various operating conditions by selectively turning on/off the blowing fan 254, the heater 250 and the water supply pump 212. The operating conditions shown in Table 1 are as follows:

Case 1; All of the blowing fan 254, the heater 250 and the water supply pump 212 are operated. In this case, the air in the washing chamber 204 is heated and the supplied water is heated at the same time.

Case 2; Only the blowing fan 254 and the heater 250 are operated. Since the water is not supplied into the washing chamber 204, only the air in the washing chamber 204 is heated.

Case 3; Only the blowing fan 254 is operated. This case is applied to a drying process or any process requiring a high latent heat of the dishes.

Case 4; Only the heater 250 and the water supply pump 212 are operated. The air in the washing chamber 204 is not heated, and only the water supplied into the washing chamber 204 is heated. Accordingly, at least one of the upper and lower spraying nozzles 204*c* is desirably oriented toward the air inlet 252*a* of the blowing pipe 252*b* so that the water supplied into the washing chamber 204 is supplied into the blowing pipe 252*b* in the dishwasher shown in FIG. 2A.

Case 5; Only the water supply pump 212 is operated. This case is applied when heating is not required and only the water is supplied into the washing chamber 204 for example, for at an initial stage of a rinsing process or a preparatory washing process.

Figure 3:
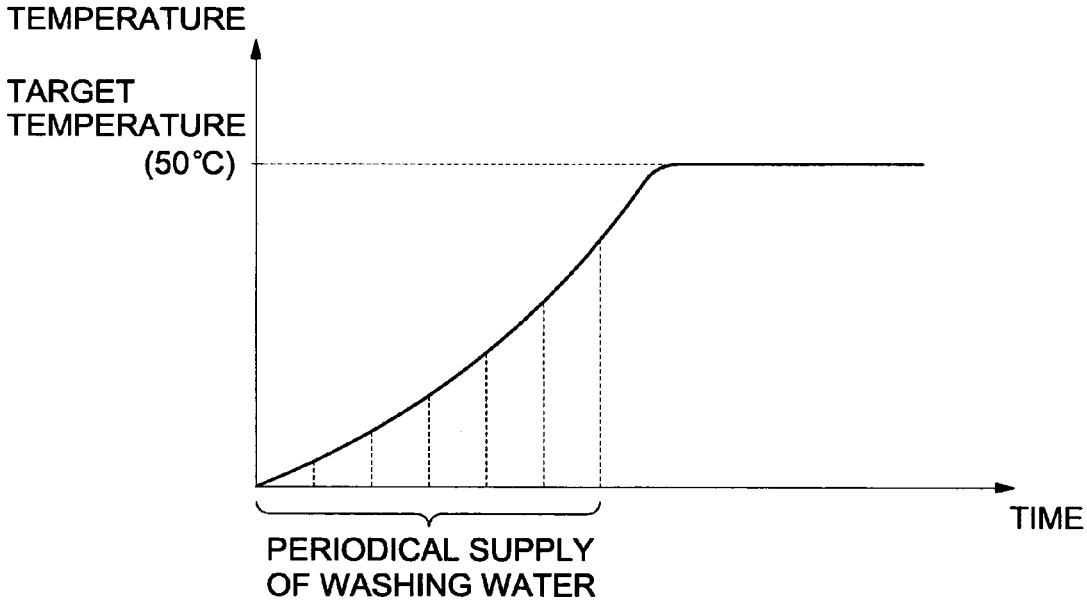
FIG. 3 is a graph of temperature and water supply control characteristics of the dishwasher, according to the first embodiment of the present invention.

FIG. 3 is a graph of temperature and water supply control characteristics of the dishwasher 200, according to the first embodiment of the present invention. As shown in FIG. 3, the air in the washing chamber 204 is continuously circulated and the heater 250 is simultaneously operated until the temperature of the air in the washing chamber 204 reaches a target temperature, that is, a set temperature. As the air in the washing chamber 204 is heated, the dishes are heated. As the dishes are heated, oil and other contaminants on the dishes are dispersed and flow down, so that a washing effect is improved and a washing period is decreased. If the temperature of the air in the washing chamber 204 increases by a certain amount, the washing water is periodically supplied into the washing chamber 204. Since the washing water is not continuously supplied but intermittently supplied, there is an adequate time for the air in the washing chamber 204 to be heated, so that the washing water is heated by the heated air. The control unit 160 may set a time point to supply the washing water to control the temperature of the air in the washing chamber 204 or driving time of the heater 250 and the blowing fan 254. That is, the washing water is supplied when the temperature of the air in the washing chamber 204 reaches a preset reference temperature or after the heater 150 and the blowing fan 254 have been operated for a preset reference time. Further, the washing water may be supplied at the same time that the heater 150 and the blowing fan 254 are operated.

The temperature of the air in the washing chamber 204 is sufficiently raised within a short period of time by heating of the air having a specific heat lower than that of the washing water, and then the washing water is supplied and heated by the heated air, so that a time required for the washing water to be heated is shortened in comparison to directly heating the washing water. Further, if the washing water is supplied after the prior removal of contaminants, such as the oil and other contaminants by heating the dishes in the washing chamber 204, a washing time is shortened and a washing efficiency is further increased. Further, the washing water may be supplied to prevent food dregs on the dishes from being dried by the hot air at the time that the air in the washing chamber 204 is heated.

Figure 4:
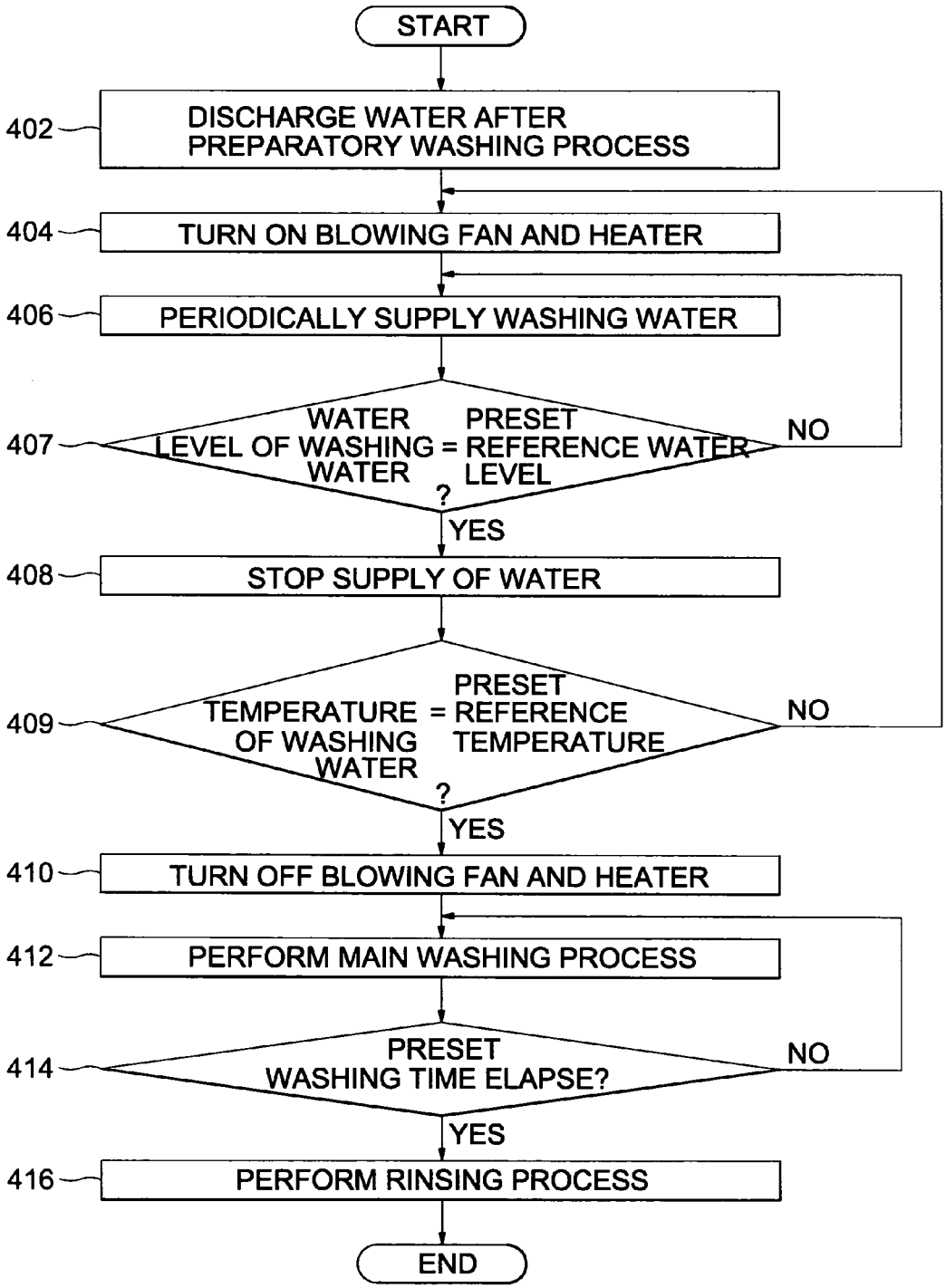
FIG. 4 is a flowchart of a washing process of controlling the dishwasher, according to the first embodiment of the present invention.

FIG. 4 is a flowchart of a washing process of the dishwasher 200, according to the first embodiment of the present invention. As shown in FIG. 4, a preparatory washing process is performed, in advance, to remove large-sized contaminants among contaminants on the dishes and then a used washing water is discharged at operation 402. Thereafter, in a main washing process to be later performed, the blowing fan 254 and the heater 250 are turned on, so that the air in the washing chamber 204 is heated at operation 404. If the temperature of the air in the washing chamber 204 is increased by a certain amount, the washing water is periodically supplied into the washing chamber 204 and then is heated by the heated air at operation 406. If the temperature of the air in the washing chamber 204 is 80~90° C., the temperature of the washing water increases to 40~50° C. Whether a water level of the washing water reaches a preset reference water level is determined at operation 407. If the water level of the washing water reaches the preset reference water level at operation 407, the supply of the washing water is stopped at operation 408. Though the supply of the washing water is stopped, the blowing fan 254 and the heater 250 are continuously operated, so that the air in the washing chamber 204 is heated, and the washing water is heated by heat exchange with the heated air. If the temperature of the washing water reaches a preset reference temperature at operation 409, the blowing fan 254 and the heater 250 are turned off at operation 410 and the main washing process is performed by a circulation of the washing water supplied at operation 412. If a preset washing time required to perform the main washing process elapses at operation 414, the main washing process is stopped and a rinsing process is performed at operation S416.

Figure 5:
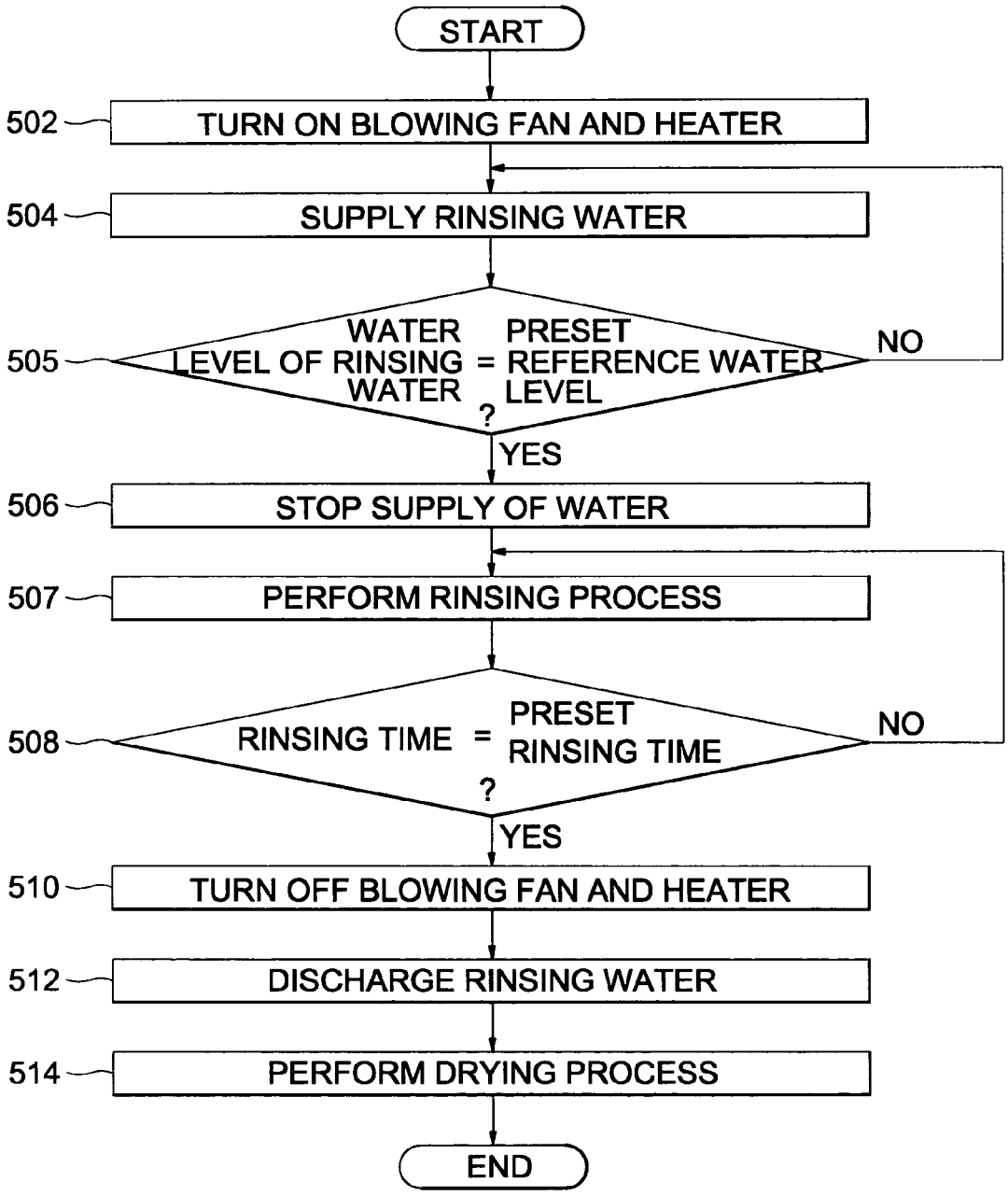
FIG. 5 is a flowchart of a rinsing process of the dishwasher, according to the first embodiment of the present invention.

FIG. 5 is a flowchart of the rinsing process of the dishwasher, according to the first embodiment of the present invention. In particular, FIG. 5 is a flowchart of a last operation of the rinsing process. As shown in FIG. 5, when the last operation of the rinsing process is started, the blowing fan 254 and the heater 250 are turned on, and the air in the washing chamber 204 is heated at operation 502. If the temperature of the air in the washing chamber 204 is increased by a certain amount, rinsing water is supplied at operation 504. The rinsing water is supplied and heated by the air heated in the washing chamber 204. Though the rinsing water may not be heated, a disinfection effect is improved if the rinsing water used for the last operation of the rinsing process is heated. Further, in the case where a drying process is continuously performed after the rinsing process, drying is rapidly performed by latent heat of the heated dishes. Whether the water level of the rinsing water has reached a preset reference water level is determined at operation 505. If the water level of the rinsing water has reached the preset reference water level, the supply of the rinsing water is stopped at operation 506 and the last operation of the rinsing process is performed at operation 507. Once a rinsing time reaches a preset rinsing time, the blowing fan 254 and the heater 250 are turned off at operation 510 and used rinsing water is discharged at operation 512. When the rinsing process is completed, the drying process is performed at operation 514.

The dishwasher 200 uses a method of blowing heated air into a washing chamber 204, the dishwasher performs an independent drying process not accompanied by a rinsing process using hot water and dries previously washed dishes, which is different from the conventional dishwasher 100. That is, the conventional dishwasher 100 heats dishes by rinsing the dishes using the hot water before performing the drying process, and dries the dishes using latent heat of the heated dishes in the drying process. To the contrary, the dishwasher 200 dries dishes through the air heated at the time of performing the independent drying process, so that the dishwasher need not heat the dishes through rinsing of the dishes using the hot water as in the conventional dishwasher 100.

Figure 6:
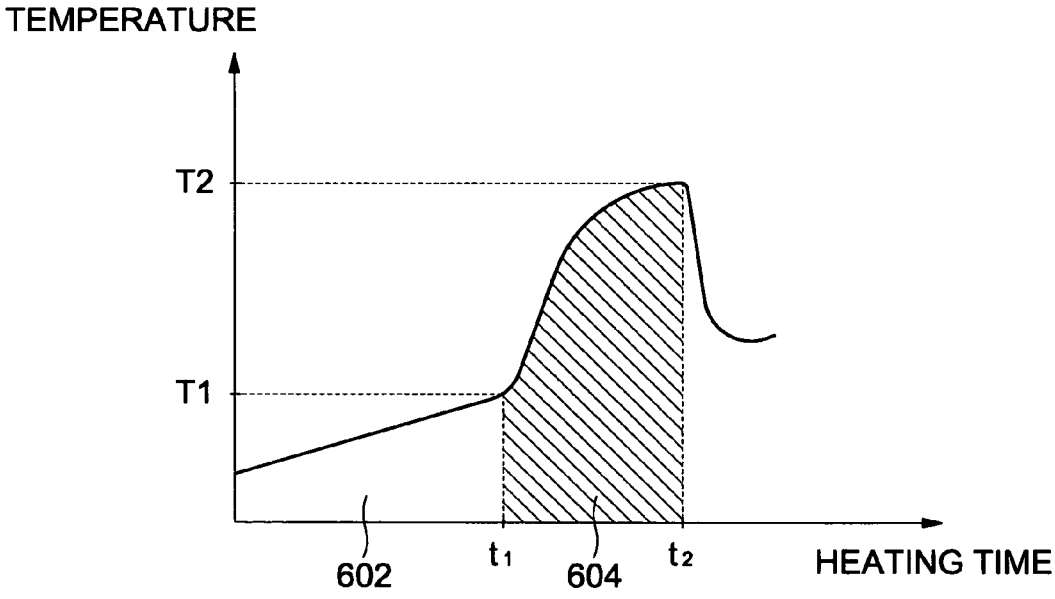
FIG. 6 is a graph showing temperature and water supply control characteristics of the dishwasher, according to the first embodiment of the present invention.

FIG. 6 is a graph showing temperature and water supply control characteristics of the dishwasher 200, according to the first embodiment of the present invention, which illustrates a temperature curve showing a variation of temperature in the washing chamber 204. In FIG. 6, the temperature curve shown in a first period 602 (i.e., from time 0 to t1) is the temperature of water in the washing chamber 204, and in a second period 604 (i.e., from time t1 to t2) is the temperature of air in the washing chamber 204. In the first period 602 the temperature of the water is required to reach a first target temperature T1, and all of the blowing fan 254, the heater 250 and the water supply pump 212 are operated. In the first period 602, the air in the washing chamber 204 is heated and the water is simultaneously supplied. At this time, a heat exchange is generated between the water and the air, so that the temperature of the water is relatively slowly increased. If the temperature of the water in the washing chamber 204 reaches the first target temperature T1, an operation of the water supply pump 212 is stopped. Accordingly, since the supply of the water is stopped, heating of the air by the heater 250 is accelerated, and therefore the temperature of the air reaches a second target temperature T2 in a short period of time. In the second period 604 ranging in a time from t1 to t2, only the blowing fan 254 and the heater 50 are operated. If the temperature of the air in the washing chamber 204 reaches the second target temperature T2, the operation of the water supply pump 212 restarts, so that the temperature of the air in the washing chamber 204 rapidly decreases.

The second period 604 applies to a case where very high temperature is needed, for example, a lipstick residue remaining on a cup. Since lipstick has a high melting point of more than 80° C., to remove the lipstick remaining on the cup, the washing water should be heated to a high temperature of more than 80° C. or the air around the cup should be heated to a temperature of more than 80° C. A relatively long time is required to heat the water in the washing chamber 204 to the high temperature. Accordingly, if the air in the washing chamber 204 is heated, the air in the washing chamber 204 may quickly reach a target temperature, compared to the case that the water in the washing chamber 204 is heated. The reason for the air in the washing chamber 209 reaching the target temperature quicker is that the specific heat of the air is lower than that of the water. Accordingly, the oil from food, as well as lipstick may be dispersed and removed when the temperature is high, so that the method is very useful to wash dishes stained with the oil.

Figure 7:
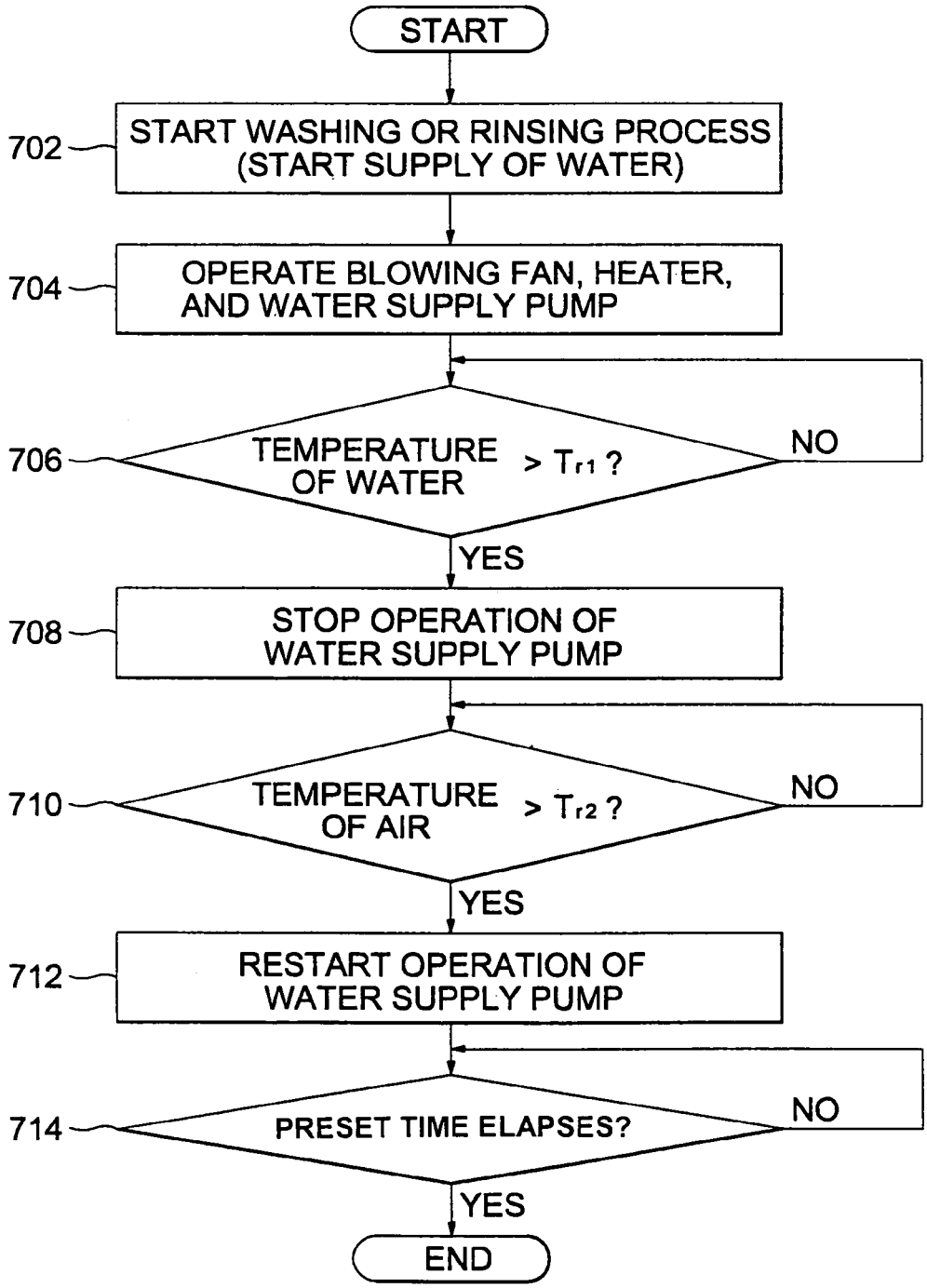
FIGS. 7 and 8 are flowcharts showing methods of controlling the dishwasher, according to second and third embodiments, respectively, of the present invention.
Figure 8:
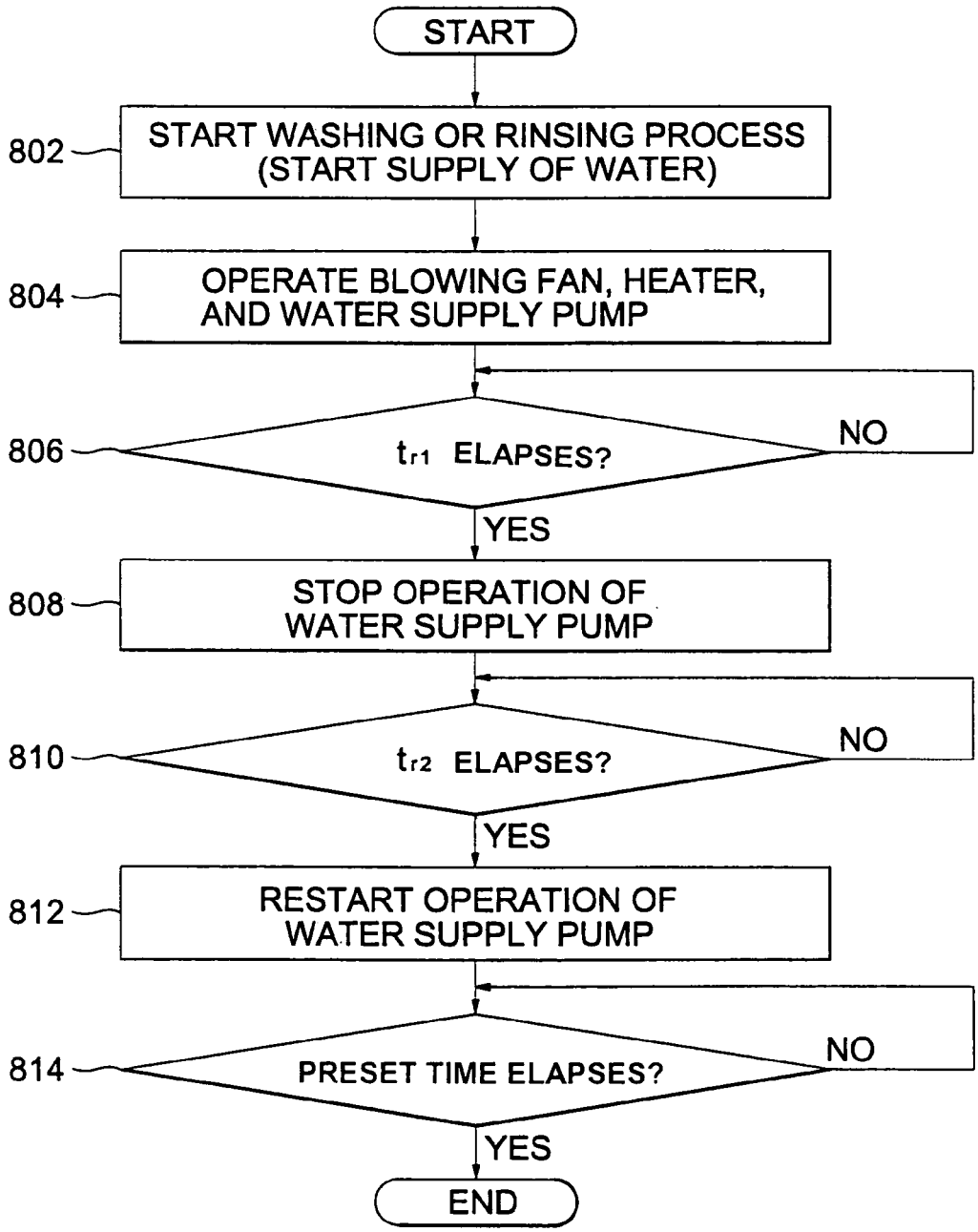

FIGS. 7 and 8 are flowcharts showing methods of controlling the dishwasher 200 according to second and third embodiments of the present invention, which show methods of controlling the dishwasher to obtain the graph shown in FIG. 6. FIG. 7 is a flowchart of a method of controlling the dishwasher 200 based on the variation of the temperature of air in the washing chamber 204. As shown in FIG. 7, the water is supplied into the washing chamber 204 at the same time that the washing or rinsing process is started at operation 702. At this time, the water supply pump 212, the heater 250 and the blowing fan 254 are operated to heat air in the washing chamber 204 and water supplied into the washing chamber 204 at operation 704. If the temperature of the water in the washing chamber 204 exceeds a first reference temperature $T_{r1}$ at operation 706, the operation of the water supply pump 212 is stopped to stop the supply of the water at operation 708. Thereafter, only the blowing fan 254 and the heater 250 are continuously operated. If the temperature of the air in the washing chamber 204 exceeds a second reference temperature $T_{r2}$ at operation 710, the operation of the water supply pump 212 is restarted to supply water into the washing chamber 204, and the washing of dishes is carried out at operation 712. In this case, since the dishes in the washing chamber 204 are sufficiently heated by the air heated to a high temperature, lipstick or oil with a high melting point may be easily removed. Thereafter, if a preset time elapses for the washing or rinsing process, a corresponding process ends at operation 714.

FIG. 8 is a flowchart of a method of controlling the dishwasher based on an execution time of each process. As shown in FIG. 8, water is supplied into the washing chamber 204 at a same time that a washing or rinsing process is started at operation 802. At this time, the water supply pump 212, the heater 250 and blowing fan 254 are operated to heat the air in the washing chamber 204 and the water supplied into the washing chamber 204 at operation 804. If a first reference time $t_{r1}$ elapses from a time of starting the washing or rinsing process, the operation of the water supply pump 212 is stopped to stop the supply of the water at operation 808. Thereafter, only the blowing fan 254 and the heater 250 are continuously operated. If a second reference time $t_{r2}$ elapses from the time of starting the washing or rinsing process at operation 810, the operation of the water supply pump 212 is restarted to supply water into the washing chamber 204, and the washing of dishes is performed at operation 812. Thereafter, if the preset time elapses for the washing or rinsing process, a corresponding process ends at operation 814. That is, each process is performed based on the variation of the temperature in the control method shown in FIG. 7, while each process is performed based on the execution time in the control method shown in FIG. 8. In this case, each of the first and second reference times $t_{r1}$ and $t_{r2}$ are values obtained by taking a mean of times required to reach each of the first and second reference temperatures $T_{r1}$ and $T_{r2}$ through many tests of the dishwasher 200 at a product development stage.

The dishwasher 200 constructed as described above heats the air in the washing chamber in the washing process and simultaneously supplies the washing water, thus heating dishes and the washing water in the washing chamber 204 through the heated air. An air generator operates and the air in the washing chamber 204 is continuously circulated until the temperature of the air in the washing chamber 204 reaches a target temperature, that is, a set temperature. As the air in the washing chamber 204 is heated, the dishes are heated. As the dishes are heated, oil and other contaminants on the dishes disperse and flow down, so that a washing effect is improved and a washing time is decreased.

The temperature of the air in the washing chamber 204 is sufficiently raised within a short period of time by the heating of the air having a specific heat lower than that of the washing water, and the washing water is supplied and heated by the heated air, so that a time required for the washing water to be heated is shortened in comparison to a time to directly heat the washing water. Further, if the washing water is supplied after the prior removal of contaminants, such as the oil and other contaminants, heating the dishes in the washing chamber 204, the washing time is shortened and the washing efficiency is further increased. Further, the washing water may be supplied to prevent food dregs on the dishes from being dried by the hot air at the time that the air in the washing chamber 204 is heated.

The dishwasher of the present invention first heats air having a specific heat lower than that of water, and heats dishes, washing water and rinsing water using the heated air, so that a period of time required for the washing water to be heated is shortened in comparison to direct heating of the washing water. Further, the dishwasher increases an energy consumption efficiency by performing an independent drying process without the rinsing process using hot water. Further, since a heater is not submerged under the water, compounds of calcium do not form on a surface of the heater, so that a lifetime of the heater is greatly extended.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method of controlling a dishwasher having a washing chamber, comprising:

heating air for the washing chamber in a heater positioned outside the washing chamber;

supplying the heated air to the washing chamber with a blowing fan;

supplying water into the washing chamber; and generating hot water through a heat exchange between the heated air and the supplied water, wherein the heating of the air in the washing chamber is performed at an initial stage of the rinsing process.

2. The method as set forth in claim 1, wherein the water is periodically supplied when the air in the washing chamber is heated to a preset reference temperature.

3. The method as set forth in claim 1, further comprising:

controlling the heat exchange between the heated air and the water supplied into the washing chamber to heat the water supplied into the washing chamber if an air generator is operated longer than a preset time.

4. The method as set forth in claim 1, further comprising:

controlling the heat exchange between the heated air and the water supplied into the washing chamber to heat the water supplied into the washing chamber as soon as an air generator is operated.

5. The method as set forth in claim 1, wherein the heating of the air comprises:

sucking outside air into the washing chamber; and recirculating the air in the washing chamber.

6. The method as set forth in claim 1, wherein the supplying of the water comprises:

intermittently supplying the water if a temperature of the air in the washing chamber reaches a first temperature to heat the water in the washing chamber by the heated air.

7. The method as set forth in claim 1, further comprising;

drying dishes using the heated air.

8. The method as set forth in claim 1, wherein the heating of the air comprises:

one of sucking external air into the washing chamber and recirculating internal air from within the washing chamber to heat the air.

9. A method of controlling a dishwasher having a washing chamber, comprising:

heating air for the washing chamber in a heater positioned outside the washing chamber;

supplying the heated air to the washing chamber with a blowing fan;

supplying water into the washing chamber; and generating hot water through a heat exchange between the heated air and the supplied water, wherein the heating of the air for the washing chamber is performed at each of initial stages of washing and rinsing processes, and the washing and rinsing processes are each performed using the generated hot water.

10. The method as set forth in claim 9, wherein:

the rinsing process comprises:

two or more rinsing operations; and a last one of the two or more rinsing operations comprises:

rinsing dishes using the generated hot water.

11. A method of controlling a dishwasher having a washing chamber, comprising:

heating air for the washing chamber in a heater positioned outside the washing chamber;

supplying the heated air to the washing chamber with a blowing fan;

supplying water into the washing chamber;

generating hot water through a heat exchange between the heated air and the supplied water; and circulating the air in the washing chamber through a pipe, wherein the heating of the air comprises heating the air circulated through the pipe, wherein the circulating of the air is continuous, the heating is simultaneous with the circulating of the air until an air temperature in the washing chamber reaches a first temperature, and the supplying of the water comprises periodically supplying the water if the air temperature in the washing chamber reaches the first temperature.

12. The method as set forth in claim 11, wherein:

the circulating of the air in the washing chamber comprises:

continuously circulating the air in the washing chamber;

the heating of the air in the washing chamber comprises:

simultaneous with the continuous circulating of the air heating the air in the washing chamber until a temperature of the air reaches a first temperature; and the supplying of the water into the washing chamber comprises:

periodically supplying the water into the washing chamber if the temperature of the air in the washing chamber reaches the first temperature.

13. The method as set forth in claim 12, wherein the supplying of the water into the washing chamber further comprises:

periodically supplying washing water if the temperature of the air in the washing chamber reaches a preset temperature or one of a heater and a blowing fan operates for a preset time.

14. A method of controlling a dishwasher having a washing chamber, comprising:

heating air for the washing chamber in a heater positioned outside the washing chamber;

supplying the heated air to the washing chamber with a blowing fan;

supplying water into the washing chamber;

generating hot water through a heat exchange between the heated air and the supplied water; and rinsing dishes in a rinsing process by the hot water.

15. The method as set forth in claim 14, wherein the rinsing process is performed at least two times.

16. A method of controlling a dishwasher having a washing chamber and an air generator that provides hot air into the washing chamber, the air generator having a heater and a blowing fan, comprising:

starting supplying of water into the washing chamber;

operating the air generator, the hot air from the air generator heating the supplied water in the washing chamber;

stopping the supplying of water and operating the air generator if a preset variable corresponding to a property of the washing chamber exceeds a first value; and starting the supplying of water if the preset variable of the washing chamber exceeds a second value.

17. The method as set forth in claim 16 wherein the starting of the supplying of the water occurs at a common time with starting of one of washing and rinsing processes.

18. The method as set forth in claim 16, wherein:

the first value is a temperature of the water in the washing chamber; and the reference value is a temperature of the air in the washing chamber.

19. The method as set forth in claim 16, wherein the first value is more than 60° C.

20. The method as set forth in claim 16, wherein:

the first value is an average time required for a temperature of the water in the washing chamber to reach a preset temperature; and the second value is an average time required for a temperature of the air in the washing chamber to reach a preset temperature.

21. The method as set forth in claim 20, wherein:

the first value ranges from about 15 to 25 minutes; and the second value ranges from about 5 to 10 minutes.

22. A method of controlling a dishwasher having a washing chamber, comprising:

heating air for the washing chamber in a heater positioned outside the washing chamber;

supplying the heated air to the washing chamber with a blowing fan;

supplying water into the washing chamber;

generating hot water through a heat exchange between the heated air and the supplied water; and controlling the dishwasher to allow a heat exchange between the heated air and water fed into the washing chamber in response to an operation of an air generator for a period of time equal to or exceeding a predetermined time period to heat the water fed into the washing chamber.

23. A method of controlling a dishwasher having a washing chamber, comprising:

heating air for the washing chamber in a heater positioned outside the washing chamber;

supplying the heated air to the washing chamber with a blowing fan;

supplying water into the washing chamber;

generating hot water through a heat exchange between the heated air and the supplied water; and controlling the dishwasher to allow a heat exchange between the heated air and water fed into the washing chamber in response to a start of an operation of an air generator to heat the water fed into the washing chamber.

24. A method of controlling a dishwasher having a washing chamber, comprising:

heating air for the washing chamber in a heater positioned outside the washing chamber;

supplying the heated air to the washing chamber with a blowing fan;

supplying water into the washing chamber;

generating hot water through a heat exchange between the heated air and the supplied water; and performing a main washing process comprising:

if a temperature of the air in the washing chamber is increased by a predetermined amount, periodically supplying the water into the washing chamber and then heating the water by the heated air, determining whether a water level of the water reaches a preset water level;

if the water level of the washing water reaches the preset water level, stopping the supplying of the water, while continuously heating and circulating the air in the washing chamber, if a temperature of the water reaches a preset temperature, stopping the heating and circulating of the air and circulating the water supplied, and if a preset washing time elapses, stopping the main washing process.

25. A method of controlling a dishwasher having a washing chamber, comprising:

heating air for the washing chamber in a heater positioned outside the washing chamber;

supplying the heated air to the washing chamber with a blowing fan;

supplying water into the washing chamber;

generating hot water through a heat exchange between the heated air and the supplied water; and performing a rinsing process comprising:

if a temperature of the air in the washing chamber is increased by a predetermined amount, supplying the water into the washing chamber and then heating the water by the heated air in at least a last operation of the rinsing process, determining whether a water level of the water reaches a preset water level;

if the water level of the washing water reaches the preset water level, stopping the supplying of the water, and performing the last operation of the rinsing process, and if a rinsing time reaches a preset period, stopping the heating and circulating of the air in the washing chamber and discharging the water supplied.

26. A method of controlling a dishwasher having a washing chamber, comprising:

heating air for the washing chamber in a heater positioned outside the washing chamber;

supplying the heated air to the washing chamber with a blowing fan;

supplying water into the washing chamber; and generating hot water through a heat exchange between the heated air and the supplied water, wherein the generating of hot water comprises:

increasing a temperature of the generated hot water by simultaneously performing the heating of the air in the washing chamber and the supplying of the water;

stopping the supply of the water, if the temperature of the water in the washing chamber reaches a first target temperature to accelerate a rate of temperature change of the heated air;

restarting the supply of the water, if the temperature of the heated air in the washing chamber reaches a second target temperature to decrease the temperature of the air in the washing chamber.

27. A method of controlling a dishwasher having a washing chamber, comprising:

heating air for the washing chamber in a heater positioned outside the washing chamber;

supplying the heated air to the washing chamber with a blowing fan;

supplying water into the washing chamber; and generating hot water through a heat exchange between the heated air and the supplied water, wherein the supplying of the water comprises:

periodically supplying the water according to one of the air temperature in the dishwashing chamber reaching a preset temperature and of a heater and a fan operating for a preset period.

* * * * *

UNITED STATES PATENT AND TRADEMARK OFFICE

CERTIFICATE OF CORRECTION

PATENT NO. : 7,093,604 B2
APPLICATION NO. : 10/689518
DATED : August 22, 2006
INVENTOR(S) : Tae-Young Jung et al.

It is certified that error appears in the above-identified patent and that said Letters Patent is hereby corrected as shown below:

Column 9, Line 61, after “comprising” change “;” to --:--.

Column 11, Line 19, after “claim 16” insert --,--.

Signed and Sealed this

Twentieth Day of February, 2007

JON W. DUDAS
*Director of the United States Patent and Trademark Office*